US006193547B1

(12) United States Patent
Tung

(10) Patent No.: US 6,193,547 B1
(45) Date of Patent: Feb. 27, 2001

(54) ELECTRICAL CARD CONNECTOR

(75) Inventor: Shun-Chi Tung, Tu-Chen (TW)

(73) Assignee: Hon Hai Precision Ind. Co., Ltd., Taiepi Hsien (TW)

( * ) Notice: Subject to any disclaimer, the term of this patent is extended or adjusted under 35 U.S.C. 154(b) by 0 days.

(21) Appl. No.: 09/428,127

(22) Filed: Oct. 26, 1999

(30) Foreign Application Priority Data

Dec. 11, 1998 (TW) ..... 87220690

(51) Int. Cl.[7] ..... H01R 13/66
(52) U.S. Cl. ..... 439/541.5; 439/570
(58) Field of Search ..... 439/64, 541.5, 439/79, 159, 570

(56) References Cited

U.S. PATENT DOCUMENTS 5,176,523 * 1/1993 Lai ..... 439/64
5,249,983 * 10/1993 Hirai ..... 439/573
5,318,452 * 6/1994 Brennian, Jr. et al. ..... 439/79
5,324,204 * 6/1994 Lwee ..... 439/64
5,490,791 * 2/1996 Yamada et al. ..... 439/159
5,688,143 * 11/1997 McHugh et al. ..... 439/570
5,879,187 * 3/1999 Cheng et al. ..... 439/570

* cited by examiner

*Primary Examiner*—Gary F. Paumen
(74) *Attorney, Agent, or Firm*—Wei Te Chung

(57) ABSTRACT

An electrical card connector having an upper and a lower shells, two stand-offs and a guiding rack for securing the shells and stand-offs together. A number of projecting blocks are formed on the guiding rack for aiding in securing the guiding rack to the upper and lower shells.

1 Claim, 4 Drawing Sheets

ELECTRICAL CARD CONNECTOR

BACKGROUND OF THE INVENTION

The present invention relates to an electrical card connector, and especially to an electrical card connector having an integrally molded shell and a guiding rack for guiding a mating electrical card inserted thereto and for securing the integrally molded shell and other components of the connector.

Components of a computer are commonly designed to meet miniaturization requirements while providing high quality functional capabilities. Electrical card connectors for portable computers have developed from a single card type to a double card type for effectively expanding applications of the computer. Recently, an electrical card connector with an integrally molded metal shell in place of similar insulative components has become commonly used. Such a shell usually forms inwardly bent tabs at appropriate positions for guiding the insertion of a mating electrical card. However, the tabs can not provide enough support and may deform when a relatively large insertion force is exerted to thereon. In addition, the tabs can not effectively assemble an upper shell and a lower shell. Furthermore, a stand-off is necessary for promoting an efficient use of space of the connector within a computer.

A pertinent prior art is shown in U.S. Pat. No. 5,591,047 as seen in FIG. 1 which discloses a connector having an integrally molded shell 1 comprising an upper shell 11 and a lower shell 12. A space (not labeled) is formed between the upper and lower shells 11, 12. Each shell 11, 12 defines a plurality of rectangular apertures, wherein two of the apertures 111, 121 are for receiving tabs 131 of a stand-off 13. A protrusion 132 is formed at a middle portion of the stand-off 13 for insertion into the space between the upper and lower shells 11, 12 thereby securing the stand-off 13 to the shell 1. Moreover, a mounting seat 133 extends from a bottom edge of the stand-off 13 and defines a through hole 134 therein for attaching to a mother board. However, the stand-off 13 is only attached to the shell 1 by engagement with the tabs 131. Thus, when a relatively large force is exerted on the connector, the tabs 131 can not maintain engagement with the shell due to the limited engagement area therebetween.

BRIEF SUMMARY OF THE INVENTION

A main object of the present invention is to provide an electrical card connector having an upper and a lower shells for receiving a pair of headers therein and a guiding rack forming a plurality of projecting blocks thereon for integrally fixing the upper and lower shells and a stand-off together.

Another object of the present invention is to provide an electrical card connector having a guiding rack attached to an upper and lower shells thereby facilitating engagement of electrical card connectors inserted into the connector and facilitating the attachment of other components such as a stand-off.

In accordance with one aspect of the present invention, an upper and a lower shells are assembled together to form a receiving space therebetween. A pair of headers are received in the space. A rear surface is formed on one side of the headers opposite a front mating surface thereof. A plurality of slots are formed between the front mating and rear surfaces for receiving a plurality of conductive contacts therein.

A guiding rack is provided on one side of the upper and lower shells for guiding mating electrical cards to be inserted into the connector. The guiding rack is fixed to the upper and lower shells by inteferentially fitting projecting blocks of the guiding rack into apertures of the upper and lower shells. The guiding rack also facilitates the assembly of other components to the upper and lower shells. Furthermore, two stand-offs are directly fixed to corresponding projecting blocks of the guiding rack thereby securing the shell and the stand-offs to the electrical card connector.

Other objects, advantages and novel features of the invention will become more apparent from the following detailed description when taken in conjunction with the accompanying drawings.

DETAILED DESCRIPTION OF THE INVENTION

Figure 1:
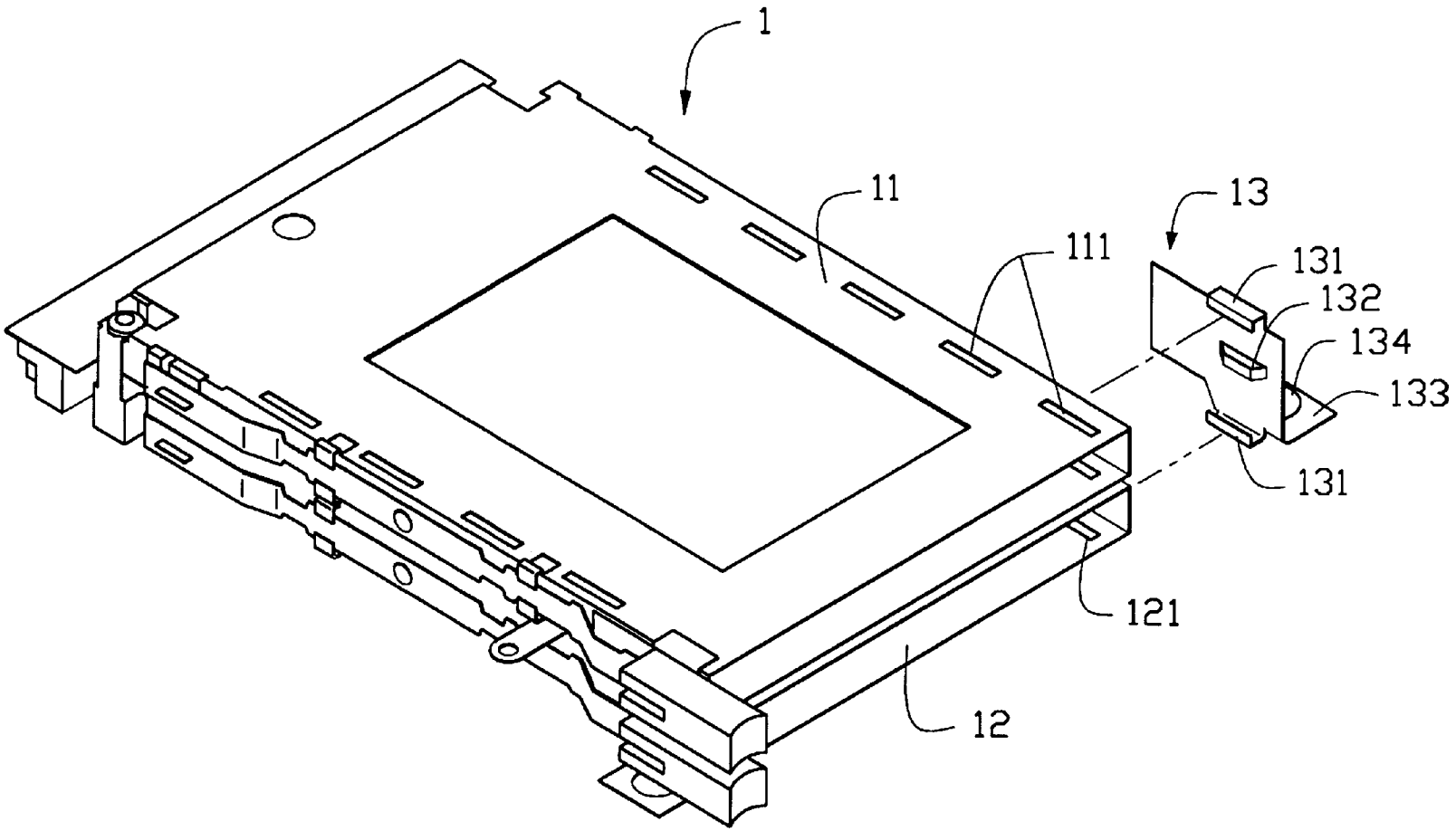
FIG. 1 (PRIOR ART)
FIG. 1 is a perspective view of a conventional electrical card connector.
Figure 2:
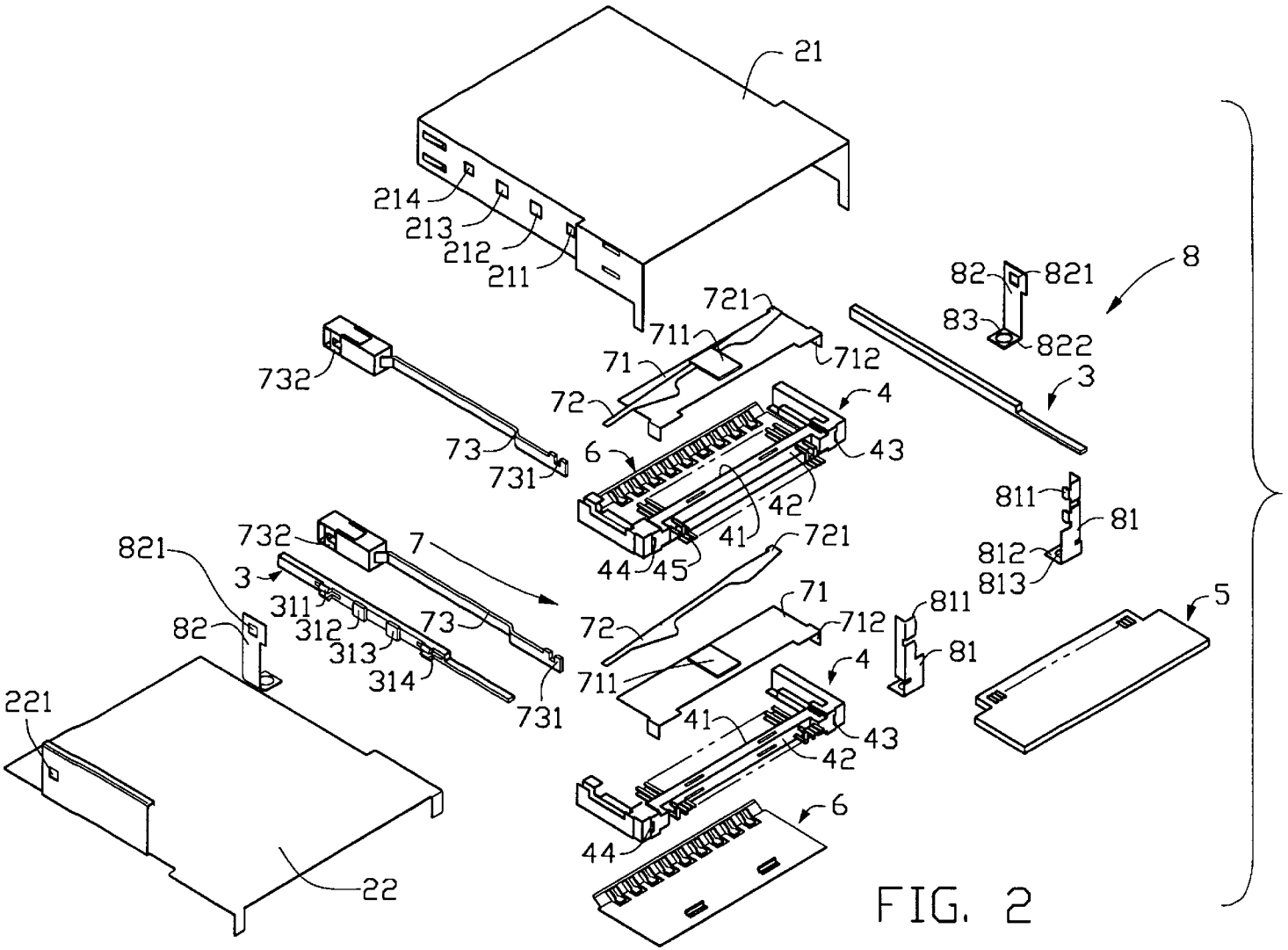
FIG. 2 is an exploded view of an electrical card connector in accordance with the present invention.

Referring to FIG. 2, an electrical card connector in accordance with the present invention mainly comprises an upper shell 21, a lower shell 22, a guiding rack 3, two headers 4, a transfer board 5, two grounding plates 6, two ejection devices 7 and two stand-offs 8. The upper shell 21 and the lower shell 22 are assembled together thereby defining a space for receiving a mating electrical card (not shown). The upper shell 21 has a top surface and two side surfaces. Rectangular apertures 211, 212, 213, 214 are sequentially formed in each side surface. One side surface extends from an edge of the lower shell 22 and forms a rectangular aperture 221.

The guiding rack 3 divides the space formed between the upper and lower shells 21, 22 into an upper chamber and a lower chamber, and effectively guides an inserted mating electrical card into the corresponding chamber. Four projecting blocks 311, 312, 313, 314 are formed on one side of the guiding rack 3 for fitting in the corresponding rectangular apertures 211, 211, 213, 214 of the upper shell 21. The projecting blocks 312, 313 fix the guiding rack 3 to the shell 2, while the projecting blocks 311, 314 fix the guiding rack 3, the stand-offs 8 and the shell 2 together.

Each header 4 is U-shaped and has a front mating surface 41 and a rear surface 42 on opposite sides thereof. A plurality of contact receiving slots is defined between the front mating surface 41 and the rear surface 42 for receiving conductive contacts 45. One end of each contact 45 extends beyond the front mating surface 41 for electrically contacting with a mating card, and the other end of each contacts 45 extends beyond the rear surface 42 for electrically connecting with a mother board ( not shown) by means of the transfer board 5. Two apertures 43, 44 are formed at opposite ends of each header 4 between the front mating surface 41 and the rear surface 42 of the header 4 for interferentially receiving a first member 81 of each stand-off 8.

The grounding plates 6 are attached to each header 4 for enclosing and shielding the contacts 45 received therein. Each ejection device 7 includes an ejection plate 71, an actuator 72 and a push rod 73. The ejection plate 71 forms a groove 711 for pivotably engaging providing the actuator 72, and a pair of tabs 712 downwardly extending from opposite sides thereof for being secured to the header 4. The actuator 72 is pivotably attached to the ejection plate 71 by engagement between a middle portion thereof with the groove 711. The actuator 72 forms an engaging tab 721 for engaging a mating electrical card, while the other end of the actuator 72 is pivotably fixed to a free end 731 of the push rod 73 for transferring the force exerted on the push rod 73. The push rod 73 forms a driving end 732 opposite the free end 731. The driving end 732 forms a resilient handle which can extend outwardly or retract inwardly.

Each stand-off 8 comprises a L-shaped first member 81 and a second member 82. Each first member 81 forms a pair of barbs 811 for interferentially fitting in the apertures 43, 44 of the header 4 thereby distancing the header 4 from a circuit board (not shown). A fixing section 812 defines a screw hole 813 extends from a lower portion of the first member 81 for facilitating attachment to the motherboard. A rectangular aperture 821 is defined proximate a free end of each second member 82 and aligns with the rectangular aperture 214 of the shell 2. A fixing section 822 extends from the other end of each second member 82 and defines a screw hole 823 for facilitating attachment of the second members 82 to the circuit board.

Figure 3:
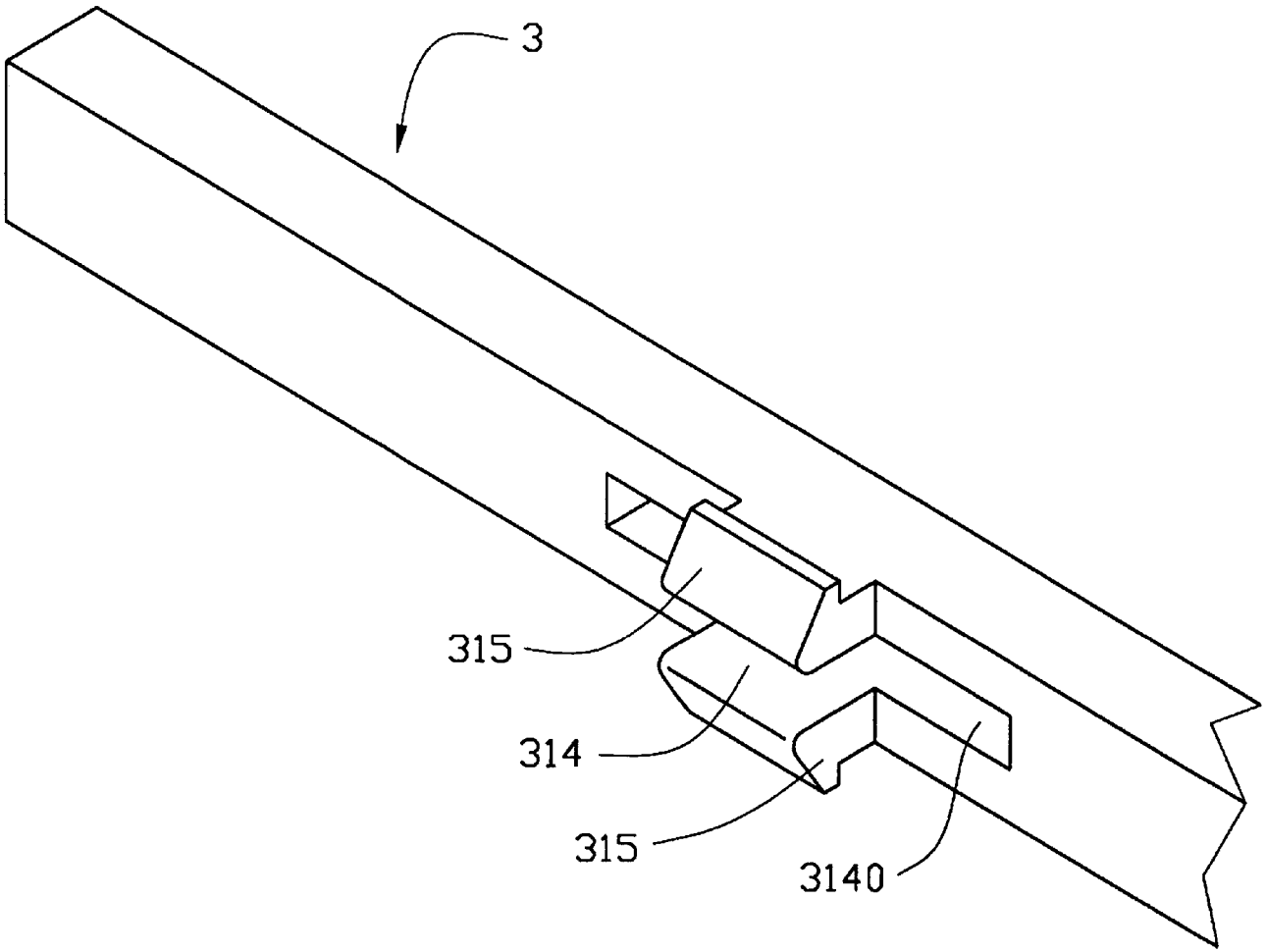
FIG. 3 is a segmental, magnified view of a guiding rack in accordance with the present invention.
Figure 4:
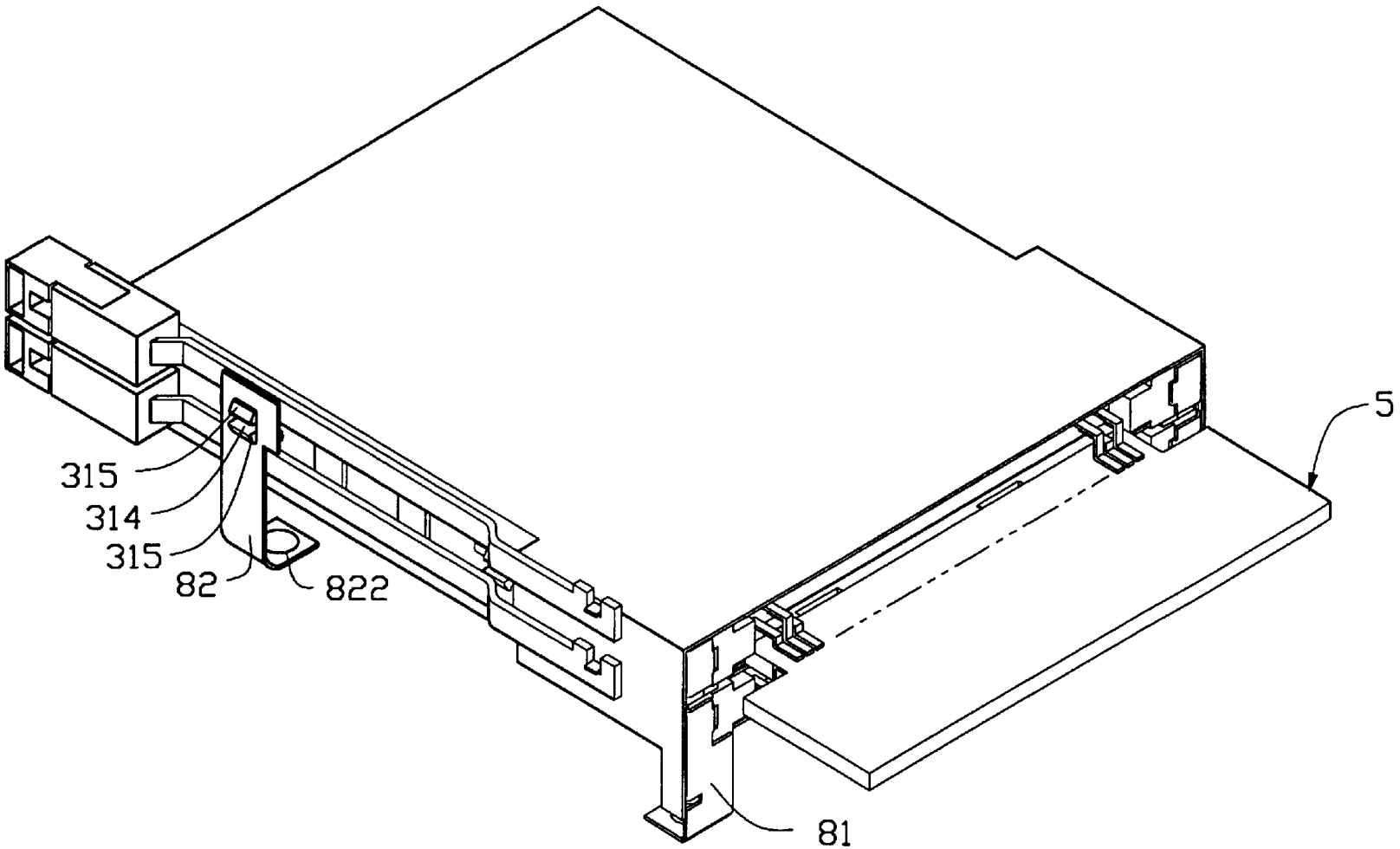
FIG. 4 is an assembled view of FIG. I omitting a lower shell.

Also referring to FIGS. 3 and 4, wherein the lower shell 22 is omitted for clearly showing cooperation of the guiding rack 732, the stand-offs 82 and the upper shell 21. The projecting blocks 311, 314 of the guiding rack 3 each consist of a pair of latches 315. Each latch 315 has an inclined outer face for facilitating insertion of the blocks 311, 314 into the corresponding rectangular apertures 214, 821 of the upper shell 21 and corresponding second members 82 of the stand-offs 8. A gap 3140 is defined between each pair of 315 for allowing inward deformation of the latches 315 during insertion into the corresponding apertures 214, 821. After insertion is complete, the latches 315 resume their original shape and the second members 82 is secured to the shells 21, 22. Therefore, the guiding rack 3 fixes the corresponding second members 82 of the stand-off 8 to the shell 2 while guiding a mating electrical card to be inserted into the connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector comprising:

a pair of stacked headers each forming a front mating surface, a rear surface and a plurality of contact receiving slots defined between the front mating surface and the rear surface;

a plurality of conductive contacts received in corresponding contact receiving slots, one end of each contact extending beyond the front mating surface for electrically connecting with a mating electrical card, the other end of each contact extending beyond the rear surface for connecting with a circuit board;

an upper shell and a lower shell assembled to enclose the headers therebetween;

a stand-off mounted onto the projecting block of the guiding rack; and a guiding rack fixed to the upper and lower shells and forming at least one projecting block for resiliently latching the aperture of the stand-off thereby securing the stand-off and the upper and lower shells together;

wherein at least one of the projecting blocks of the guiding rack is fixed into the corresponding aperture of each second members of the stand-off and the upper and lower shells thereby securely fixing the guiding rack, the stand-off and the upper and lower shells together;

wherein one of the projecting blocks of the guiding rack engages corresponding second member of the stand-off, the projecting block consisting of two latches each forming an inclined face for facilitating insertion into the apertures of the upper and lower shells, the two latches defining a gap therebetween and resiliently latching outer edges of corresponding apertures of the upper and lower shells and corresponding second member of the stand-off.

wherein the upper shell has a top surface and two opposite side surfaces, each side surface defining a plurality of apertures;

wherein a plurality of projecting blocks are formed on the guiding rack for engaging with corresponding apertures of the upper shell thereby fixing the guiding rack with the upper shell;

wherein the lower shell forms a top surface and a side surface defining an aperture therein;

wherein a projection block is formed on the guiding rack for engaging with the aperture of the lower shell thereby fixing the guiding rack with the lower shell;

wherein each stand-off consists of a first member and a second member, each second member defining an aperture proximate a free end.

* * * * *